United States Patent [19]

Mattsson et al.

[11] 4,201,071

[45] May 6, 1980

[54] MANDREL FOR HIGH PRESSURE TUBE EXTRUSION PRESS

[75] Inventors: Bertil Mattsson; Jan Nilsson, both of Robertsfors, Sweden

[73] Assignee: ASEA Aktiebolag, Vesteras, Sweden

[21] Appl. No.: 872,873

[22] Filed: Jan. 27, 1978

[30] Foreign Application Priority Data

Feb. 7, 1977 [SE] Sweden ..... 7701308

[51] Int. Cl.[2] ..... B21C 23/32; B21C 25/04

[52] U.S. Cl. ..... 72/60; 72/264; 72/481; 72/462

[58] Field of Search ..... 72/253, 264, 265, 60, 72/DIG. 31, 462, 467, 266, 267, 481; 285/355, 332; 403/296, 361, 306

[56] References Cited

U.S. PATENT DOCUMENTS

| | | | |
|---|---|---|---|
| 2,221,299 | 11/1940 | Jones | 72/264 |
| 3,074,549 | 1/1963 | Kent et al. | 72/265 |
| 3,245,701 | 4/1966 | Leopold, Jr. et al. | 285/355 X |
| 3,580,037 | 5/1971 | Issott | 72/265 |
| 3,751,958 | 8/1973 | Nilsson et al. | 72/60 |
| 3,992,913 | 11/1976 | Nilsson | 72/60 |
| 3,994,149 | 11/1976 | Dahlman | 72/60 |

FOREIGN PATENT DOCUMENTS

| | | | |
|---|---|---|---|
| 2457779 | 6/1976 | Fed. Rep. of Germany | 72/264 |
| 512115 | 8/1939 | United Kingdom | 72/264 |

*Primary Examiner*—Francis S. Husar
*Assistant Examiner*—D. M. Gurley
*Attorney, Agent, or Firm*—Watson, Cole, Grindle & Watson

[57] ABSTRACT

Disclosed is a mandrel for a high pressure tube extrusion press. The mandrel comprises a tip member providing a tip adapted to be positioned in the die opening of the press to present an annular gap for tube extrusion, and a carrier for the tip member. The carrier has a threaded central tip member receiving bore for threadably receiving a threaded segment of the tip member therein. A divided ring shaped element is disposed between a flange on the tip member and the carrier in an annular space provided at the mouth of the bore to facilitate the assembly and disassembly of the mandrel and prevent inadvertent separation of the tip member from the carrier.

5 Claims, 1 Drawing Figure

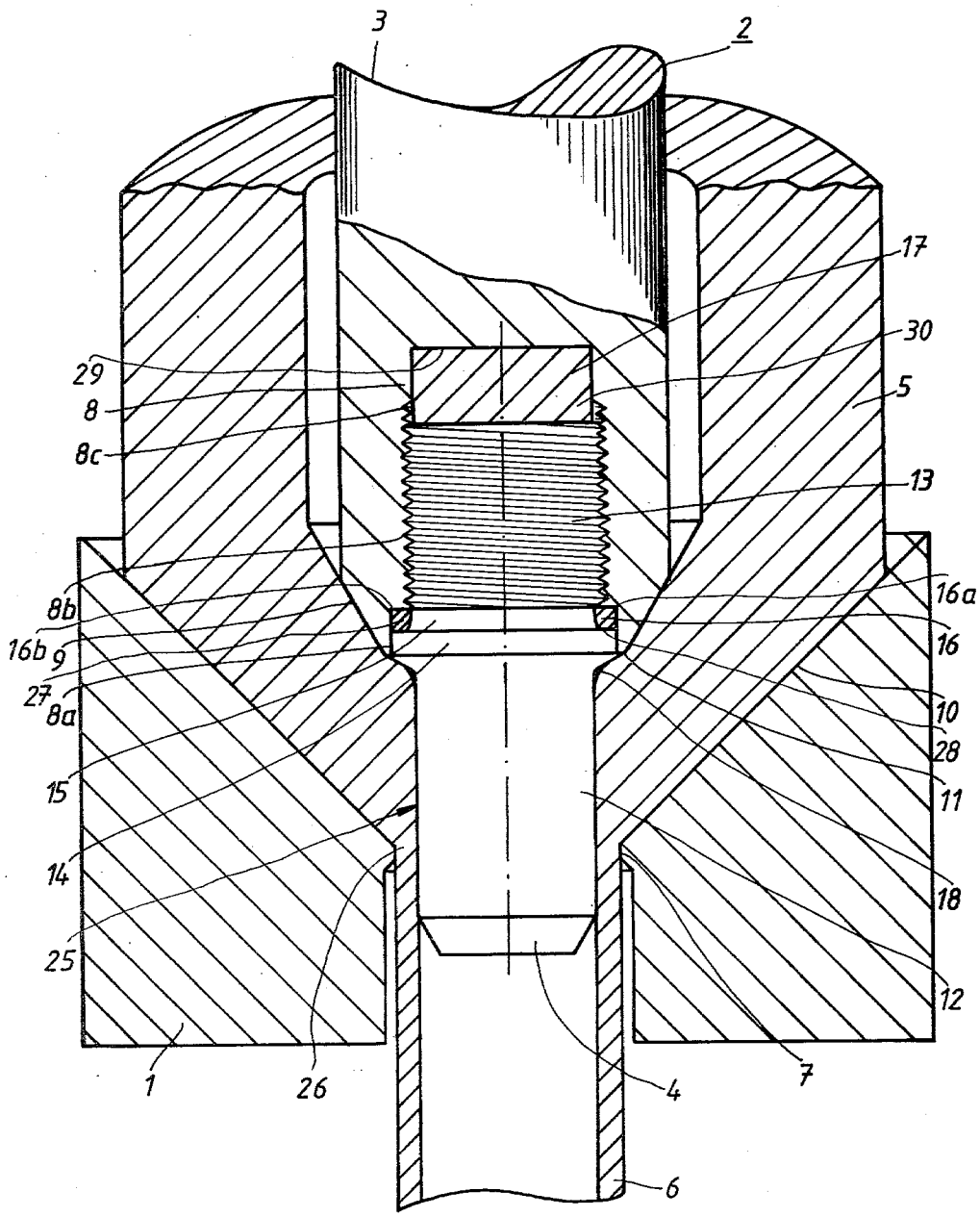
3
2
17
30
29
8
5
8c
13
8b
16a
16b
9
16
27
10
8a
28
15
11
14
18
25
12
1
26
4
7
6

MANDREL FOR HIGH PRESSURE TUBE EXTRUSION PRESS

BACKGROUND OF THE INVENTION

1. Field Of The Invention

The present invention relates to high-pressure presses for the hydrostatic extrusion of tubes, especially from heated materials and in particular relates to a new and improved mandrel useful in connection with such presses.

2. Description Of The Prior Art

The high-pressure extrusion presses to which the present invention relates generally comprise a pressure chamber defined by a high-pressure cylinder having a pressure-generating piston inserted in one end thereof and a die opening disposed at its other end. Generally a mandrel is arranged in the pressure chamber and is maintained in a fixed axial position relative to the die opening by appropriate support members. The mandrel includes a tip which projects into the die opening to present an annular gap for shaping a tubular billet into a tube with dimensions determined by the dimensions of the gap when the billet is subjected to a high, all-sided hydrostatic pressure in a surrounding pressure medium. Presses of the type described and their modes of operation are disclosed in greater detail in U.S. Pat. No. 3,751,958, the entirety of the disclosure of which is incorporated herein by reference.

When using presses as described above for extruding heated billets, the mandrels are subjected to very great stresses and the wear of mandrel tips has caused severe problems. In this regard it is pointed out that in the past it has not been practical, either technically or economically, to provide a complete mandrel which is constructed of materials suitable for withstanding heat shocks and having sufficient wear resistance to provide a desirable service life. Thus, two-piece mandrels comprising a carrier of one material and a tip of a different, durable, heat-resistant material have been used.

In such two-piece mandrels the attachment of the tip to the carrier involves a number of problems. Particularly when a mandrel is intended for use in connection with hydrostatic extrusion processes, the working pressures involved are so high that differences in the moduli of elasticity of the different materials must be considered in the design of the mandrel. Moreover, in the construction of a composite mandrel, particular measures must be taken to prevent pressure medium from penetrating between the tip and the carrier at the attachment means during the extrusion operation. Such penetration could cause inadvertent separation of the tip from the carrier. Composite mandrels useful for hydrostatic extrusion operations are described in greater detail in U.S. Pat. Nos. 3,992,913 and 3,994,149, the entirety of the disclosures of which are incorporated herein by reference.

To minimize the overall cost of the composite mandrel, the tip should easily be replaced so that the length of the period of use of the expensive carrier may be maximized. Desirably, a threaded joint might be provided. However, in the past it has been found to be difficult to use a threaded joint for attaching the tip to the carrier and at the same time obtain satisfactory exchangeability because the tips tend to become squeezed tightly in the carrier such that separation is difficult.

SUMMARY OF THE INVENTION

The foregoing problems, shortcomings and undesirable features are minimized, if not substantially eliminated, through the use of the principles and concepts of the present invention whereby is provided a mandrel for hydrostatic extrusion which includes an easily exchangeable threaded mandrel tip.

According to the invention, the mandrel tip carrier is formed with a bore having an internal thread. At the outermost portion of the bore, the diameter is equal to or greater than the outer or root diameter of the internal threads of the bore. The tip member is formed with a flange adapted to the diameter of this outermost portion of the bore and with a turned-down slot close to the flange between it and the threaded portion of the tip member. The diameter of the slot is equal to or smaller than the inner or root diameter of the threads of the tip member. In an annular space formed by the bore, the flange and the slot, there is arranged an axially divided ring which completely fills up this space. Manifestly such ring, like the remainder of the mandrel, must be constructed of a material capable of withstanding the pressures and temperatures of the high pressure extrusion operation.

The mandrel tip member may fill the bore down to its bottom, but it may also be suitable to use a filling plug which fills up the innermost portion of the bore where complete threads cannot be achieved. The front portion of the mandrel carrier is suitably formed with a conical surface with the same acute angle as or preferably a smaller acute angle than a conical inlet portion are parallel or converge in a direction toward the die. The flange of the tip member which projects into the bore is formed with a surface which meets and follows the end surface of the carrier and has generatrices which provide at least a portion thereof which forms a greater acute angle than the conical surface of the carrier whereby said portion is disposed in divergent relationship relative to said inlet portion of the die.

In another aspect the invention provides a mandrel for use in conjunction with a corresponding cylindrical die located in the cylinder of a high-pressure press useful for hydrostatically extruding tubes. The mandrel comprises an elongated tip member including a tip disposed at one end thereof adapted to be positioned in the opening of the die to present an annular gap for shaping materials into tubes. The mandrel also includes a carrier structure for said tip member which is adapted for mounting in said cylinder to fix the position of the tip relative to said die opening. The structure includes means presenting a tip member receiving bore having a relatively inner internally threaded portion and an outer cylindrical mouth portion with a diameter which is at least as great as the root diameter of the threads of the threaded portion.

The tip member further includes a threaded segment at its other end adapted for threaded engagement in said threaded portion of the bore, an annular flange disposed between said tip and said threaded segment and a neck segment disposed between the threaded segment and the flange. The outer diameter of the flange is substantially the same as the inner diameter of the mouth portion of the carrier bore and the diameter of the neck segment is no greater than the root diameter of the threads of the threaded segment. The threads of the threaded segment, said flange and said neck segment thereby define an annular slot in said tip member. The neck segment and said flange are disposed on the tip member such that said annular slot and at least a portion of the flange are positioned within said mouth portion of the carrier bore when the threaded segment of the tip member is threadably engaged in the threaded portion of the bore, to thus present an annular space in said mouth portion surrounding said neck segment. The mandrel further comprises a divided ring element constructed of a material capable of withstanding the pressures and temperatures of a high pressure extrusion operation and comprising a pair of half-ring sections for mounting on said flange in said space and in surrounding relationship to said neck segment to facilitate assembly and disassembly of the mandrel and prevent inadvertent separation of the tip member from the carrier structure during use.

In a more specific aspect of the invention, the outer diameter of said carrier structure may be greater than the diameter of said die opening.

Even more particularly, said bore may have a depth which is greater than the length of the part of the tip member disposed therein when said threaded segment of the tip member is threadably received in said threaded portion of the bore whereby to present a hollow space in said bore between the bottom of the bore and the end of the tip member. In accordance with this aspect of the invention the mandrel may further comprise a filling plug adapted for being disposed in said hollow space in substantial filling relationship thereto.

The mandrel of the invention may be used with a press which includes a generally conical inlet section in said cylinder communicating with said die opening. In this case the carrier structure will include an outer conical surface disposed in surrounding relationship to said bore and will be adapted for placement in said cylinder in concentric relationship with respect to said conical inlet section, said conical inlet section and said conical surface being relatively disposed such that they are parallel or converge in a direction toward said die opening.

The mandrel may also be such that said tip member is provided with means presenting an annular transition surface extending inwardly radially from the outer edge of said flange and generally toward said tip. Said surface of said tip member being arranged proximal said conical surface of the carrier structure when the threaded segment is threadably engaged in said threaded portion and at least a portion of said transition surface being disposed in a diverging relationship relative to said conical inlet section.

BRIEF DESCRIPTION OF THE DRAWINGS

The single FIGURE is a fragmentary view, partially in cross-section, illustrating a portion of a high-pressure hydrostatic extrusion press which includes a mandrel that embodies the concepts and principles of the present invention.

DETAILED DESCRIPTION OF THE INVENTION

Selected components of a high-pressure press useful for hydrostatically extruding tubes are illustrated in the FIGURE wherein the reference numeral 1 designates a die which is normally mounted at one end of the cylinder of a high-pressure hydrostatic extrusion press. The press includes a mandrel 2 which comprises an elongated tip member 25 and a carrier portion or structure 3 therefor. Tip member 25 includes a tip 4 which is disposed at one end thereof and which is normally positioned in the opening 7 of die 1 as illustrated. During the pressing operation, the material in a billet 5 is formed into a tube 6 in the annular gap 26 presented between the dimension-determining portion 12 of tip 4 and the internal walls of die opening 7 and in this connection it should be noted that tip portion 12 is preferably slightly conical for reasons known in this art.

The carrier structure 3 is normally mounted in the cylinder of the press in a manner to fix the position of tip 4 relative to die opening 7. The mounting means for this purpose are conventional and are not illustrated. Carrier structure 3 includes means presenting a tip member receiving bore 8 which has a central internally threaded portion **8*b*, an outer generally cylindrical unthreaded mouth portion 8*a* and an inner, incompletely threaded portion 8*c*. As shown, portion 8*b* is disposed inwardly with respect to portion 8*a* and the latter has an inner diameter which is greater than the root diameter of the threads of portion 8*b*. In this latter regard it is not necessary that portion 8*a* have a greater diameter than the roots of the threads of portion 8*b*, but the diameter of portion 8*a* should be at least as great as such root diameter. Manifestly, the outer diameter of carrier 3 is greater than the diameter of die opening 7**.

The die 1 of the press provides a generally conical inlet section 10 in the cylinder communicating with die opening 7. Carrier structure 3 includes an outer conical surface 9 which is disposed in surrounding relationship to bore 8. Section 10 and surface 9 are concentrically disposed relative to one another and the acute angle of surface 9 is smaller than the acute angle of section 10. Thus, section 10 and surface 9 are disposed such that they converge in a direction toward die opening 7. In this regard it is not necessary that section 10 and surface 9 converge in the stated direction, but they should at least be parallel and not divergent.

Carrier structure 3 also includes a small plane annular surface 11 which is located between the lower end of surface 9 and mouth portion **8*a* of bore 8. Surface 11** has a relatively small radial extension.

Tip member 25 includes a threaded segment 13 at the end thereof opposite from tip 4. Segment 13 as shown is in threaded engagement in threaded portion **8*b* of bore 8. Member 25 further comprises an annular flange 14 disposed between threaded segment 13 and tip 4 and a neck segment 15 located between segment 13 and flange 14. The outer diameter of flange 14 is substantially the same as the inner diameter of mouth 8*a* of bore 8 while the outer diameter of neck 15 is substantially the same as the root diameter of the threads of threaded segment 13. In this latter connection the outer diameter of neck 15 may be less than said root diameter of segment 13 but should not be greater. Thus, the threads of segment 13, flange 14 and neck 15 define an annular slot 27 in tip member 25**.

Neck segment 15 and flange 14 are disposed such that slot 27 and at least a portion of flange 14 are located within mouth portion **8*a* and thus present an annular space 28 disposed in mouth portion 8*a* and in surrounding relationship to neck segment 15**.

A divided filling ring element 16 comprising a pair of half-ring sections **16*a* and 16*b* is mounted in space 28 on flange 14. Ring 16 has substantially the same outer diameter as flange 14. Ring 16 is of a shape and size to substantially completely fill space 28 as can be seen. Manifestly ring 16, like the other portions of the mandrel, must be constructed of a material which is capable of withstanding the pressures and temperatures encountered during a high pressure extrusion operation. And in this latter regard ring 16** may be of a metallic material as illustrated in the drawings.

The threads in portion 8c of bore 8 of carrier 3 may generally be left incomplete to facilitate certain known manufacturing and technical limitations and accordingly the length of the part of the tip member 25 which is disposed in bore 8 will preferably be lesser than the depth dimension of bore 8. Thus, a hollow space may be presented in bore 8 between the bottom 29 of bore 8 and the end 30 of tip member 25. This hollow space may desirably be substantially completely filled by a plug 17 and to this end plug 17 may be provided with corresponding threads to fill the incomplete threads of bore portion 8c.

Tip member 25 has an annular transition surface 18 extending inwardly radially from adjacent the outer ends of flange 14 and generally toward portion 12 of tip 4. Surface 18 is generally conical immediately adjacent surface 9 of carrier 3, but may have a rounded shape as shown. The generatrices of surface 18 form a cone with a greater acute angle than the acute angle of conical surface 9. Thus, at least a portion of surface 18 is disposed in a diverging relationship relative to conical inlet section 10.

The mandrel of the present invention provides a good seal which prevents the penetration of pressure medium between the mandrel tip and the mandrel carrier. By providing the neck 15 which presents slot 27 and therefor space 28 and filling the latter with the divided ring 16, the mandrel components are made to fit sufficiently well that no cavities remain into which the material of the carrier may be pressed to thereby prevent subsequent separation of the components to replace a worn tip. Thus, the tip can be easily unscrewed and quickly and easily replaced with a new one.

By providing the mandrel tip member 25 with the transition surface 18, the divergent surfaces of the latter and the die section 10 operate to produce a slightly lower pressure at surface 18 than at the very point of connection between tip member 25 and carrier 3.

This contributes to the reduction of the risk of oil penetration between flange 14 and mouth 8a of mandrel carrier 3. Furthermore, the shape mentioned results in the collection of the accompanying pressure medium and the distribution of the same around the circumference of tip 4, thus providing improved lubrication of the mandrel tip during operation.

We claim:

1. A mandrel for use in conjunction with a corresponding cylindrical die located in the cylinder of a high-pressure press useful for hydrostatically extruding tubes, said mandrel comprising:

an elongated tip member including a tip disposed at one end thereof adapted to be positioned in the opening of the die to present an annular gap for shaping material into tubes;

a carrier structure for said tip member and adapted for mounting in said cylinder to fix the position of the tip relative to said die opening, said structure including means presenting a tip member receiving bore having a relatively inner internally threaded portion and an outer cylindrical mouth portion with a diameter which is at least as great as the root diameter of the threads of the threaded portion, said tip member including a threaded segment at its other end in threaded engagement in said threaded portion of the bore, an annular flange disposed between said tip and said threaded segment and a neck segment disposed between the threaded segment and the flange, the outer diameter of the flange being substantially the same as the inner diameter of the mouth portion and the diameter of the neck segment being no greater than the root diameter of the threads of the threaded segment, said threads of the threaded segment, said flange and said neck segment thereby defining an annular slot in said tip member, said neck segment and said flange being disposed on the tip member such that said annular slot and at least a portion of the flange are positioned within said mouth portion of the bore when the threaded segment of the tip member is threadably engaged in the threaded portion of the bore, to thus present an annular space in said mouth portion surrounding said neck segment; and a divided ring element constructed of a material capable of withstanding the pressures and temperatures of a high pressure extrusion operation and comprising a pair of half-ring sections mounted on said flange in said space and in surrounding relationship to said neck segment to facilitate assembly and disassembly of the mandrel.

2. A mandrel as set forth in claim 1 wherein the outer diameter of said carrier structure is greater than the diameter of said die opening.

3. A mandrel as set forth in claim 1 wherein said bore has a depth which is greater than the length of the part of the tip member disposed therein when said threaded segment of the tip member is threadably received in said threaded portion of the bore whereby to present a hollow space in said bore between the bottom of the bore and the end of the tip member, said mandrel further comprising a filling plug adapted for being disposed in said hollow space in substantial filling relationship thereto.

4. A mandrel as set forth in claim 1 wherein said press includes a generally conical inlet section in said cylinder communicating with said die opening, said carrier structure including an outer conical surface disposed in surrounding relationship to said bore and being adapted for placement in said cylinder in concentric relationship with respect to said conical inlet section, said conical inlet section and said conical surface being relatively disposed such that they are parallel or converge in a direction toward said die opening.

5. A mandrel as set forth in claim 4 wherein said tip member is provided with means presenting an annular transition surface extending inwardly radially from the outer edge of said flange and generally toward said tip, said surface of said tip member being arranged proximal said conical surface of the carrier structure when the threaded segment is threadably engaged in said threaded portion, at least a portion of said transition surface being disposed in a diverging relationship relative to said conical inlet section.

* * * * *